US009902163B2

(12) United States Patent
Yoshikawa et al.

(10) Patent No.: US 9,902,163 B2
(45) Date of Patent: Feb. 27, 2018

(54) LIQUID EJECTING HEAD AND LIQUID EJECTING APPARATUS

(71) Applicant: CANON KABUSHIKI KAISHA, Tokyo (JP)

(72) Inventors: Shimpei Yoshikawa, Yokohama (JP); Chiaki Muraoka, Kawaguchi (JP); Tokuji Kudo, Kawasaki (JP); Hiromasa Amma, Kawasaki (JP); Takuya Iwano, Inagi (JP); Kimiyuki Hayasaki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/154,222

(22) Filed: May 13, 2016

(65) Prior Publication Data

US 2016/0339698 A1 Nov. 24, 2016

(30) Foreign Application Priority Data

May 22, 2015 (JP) ..... 2015-104492

(51) Int. Cl.
*B41J 2/175* (2006.01)

(52) U.S. Cl.
CPC ..... *B41J 2/1753* (2013.01); *B41J 2/1752* (2013.01); *B41J 2/17526* (2013.01)

(58) Field of Classification Search
CPC ..... B41J 2/175; B41J 2/17526; B41J 2/1752
See application file for complete search history.

(56) References Cited

U.S. PATENT DOCUMENTS 5,675,366 A 10/1997 Hayasaki et al.
7,607,758 B2 10/2009 Hatasa et al.
8,109,610 B2 * 2/2012 Toge ..... B41J 2/14072 347/50
9,156,263 B2 10/2015 Kodoi et al.
9,238,361 B2 1/2016 Muraoka et al.

FOREIGN PATENT DOCUMENTS

JP 09-174822 A 7/1997

OTHER PUBLICATIONS

U.S. Appl. No. 15/154,326, filed May 13, 2016, Shimpei Yoshikawa, Chiaki Muraoka, Tokuji Kudo, Hiromasa Amma, Takuya Iwano, Kimiyuki Hayasaki.

* cited by examiner

*Primary Examiner* — Geoffrey Mruk
(74) *Attorney, Agent, or Firm* — Fitzpatrick, Cella, Harper & Scinto

(57) ABSTRACT

A liquid ejecting head and a liquid ejecting apparatus that can suppress the influence of noise on a control signal includes a plurality of terminals for being electrically connected with a contact point provided in a liquid ejecting apparatus, and a liquid ejecting element substrate having a liquid ejecting element formed for ejecting liquid in response to a control signal transmitted from the liquid ejecting apparatus. The plurality of terminals includes signal terminals and ground terminals for control, for controlling the liquid ejecting element, and the signal terminals and the ground terminals for control are arranged at positions closer to the liquid ejecting element substrate than other terminals.

13 Claims, 8 Drawing Sheets

LIQUID EJECTING HEAD AND LIQUID EJECTING APPARATUS

BACKGROUND OF THE INVENTION

Field of the Invention

The present invention relates to a liquid ejecting head and a liquid ejecting apparatus.

Description of the Related Art

There is known a method in which a liquid ejecting apparatus main body and a liquid ejecting head are electrically connected by contacting contact points provided in both. In the connection, in the case where a contact point of a signal system for control for controlling a liquid ejecting element provided in the liquid ejecting head is connected before a contact point of a ground system for control is connected, so-called latch-up may be generated. In Japanese Patent Laid-Open No. H09(1997)-174822, a configuration, in which contact timing of a signal system is made later than contact timing of a ground system, is disclosed.

Recently, the number of liquid ejecting elements that are provided in a liquid ejecting head tends to be increased for high-speed processing, or print of a high-resolution image. In a case where the number of liquid ejecting elements is increased, an amount of the current flowing through a wiring for driving to drive the liquid ejecting element is also increased. In a configuration in which the wiring and a wiring for controlling the liquid ejecting element are made to run in parallel, the increase in the amount of the current also causes the increase in the influence of noise on the control signal for the liquid ejecting element, and an intended liquid ejecting operation may not be executed by the influence of noise.

In Japanese Patent Laid-Open No. H09(1997)-174822, measures against the noise are not considered, and thus the influence of noise on control signals may not be suppressed.

SUMMARY OF THE INVENTION

The present invention has been achieved in consideration of the above-described problem, and an object thereof is to provide a liquid ejecting head and a liquid ejecting apparatus which can suppress the influence of noise on a control signal.

According to a first aspect of the present invention, there is provided a liquid ejecting head comprising: a plurality of terminals for being electrically connected with a contact point provided in a liquid ejecting apparatus; and a liquid ejecting element substrate having a liquid ejecting element formed for ejecting a liquid in response to a control signal transmitted from the liquid ejecting apparatus, wherein the plurality of terminals includes a signal terminal and a ground terminal for control, for controlling the liquid ejecting element; and the signal terminal and the ground terminal for control are arranged in positions closer to the liquid ejecting element substrate than other terminals included in the plurality of terminals.

According to a second aspect of the present invention, there is provided a liquid ejecting apparatus capable of mounting a liquid ejecting head, wherein: the liquid ejecting head has a plurality of terminals for being electrically connected with a contact point provided in a liquid ejecting apparatus; and a liquid ejecting element substrate having a liquid ejecting element formed for ejecting a liquid in response to a control signal transmitted from the liquid ejecting apparatus, the plurality of terminals includes a signal terminal and a ground terminal for control, for controlling the liquid ejecting element; and the signal terminal and the ground terminal for control are arranged in positions closer to the liquid ejecting element substrate than other terminals included in the plurality of terminals.

Further features of the present invention will become apparent from the following description of exemplary embodiments (with reference to the attached drawings).

DESCRIPTION OF THE EMBODIMENTS

Hereinafter, embodiments of the present invention will be described in detail with reference to drawings.

Figure 1:
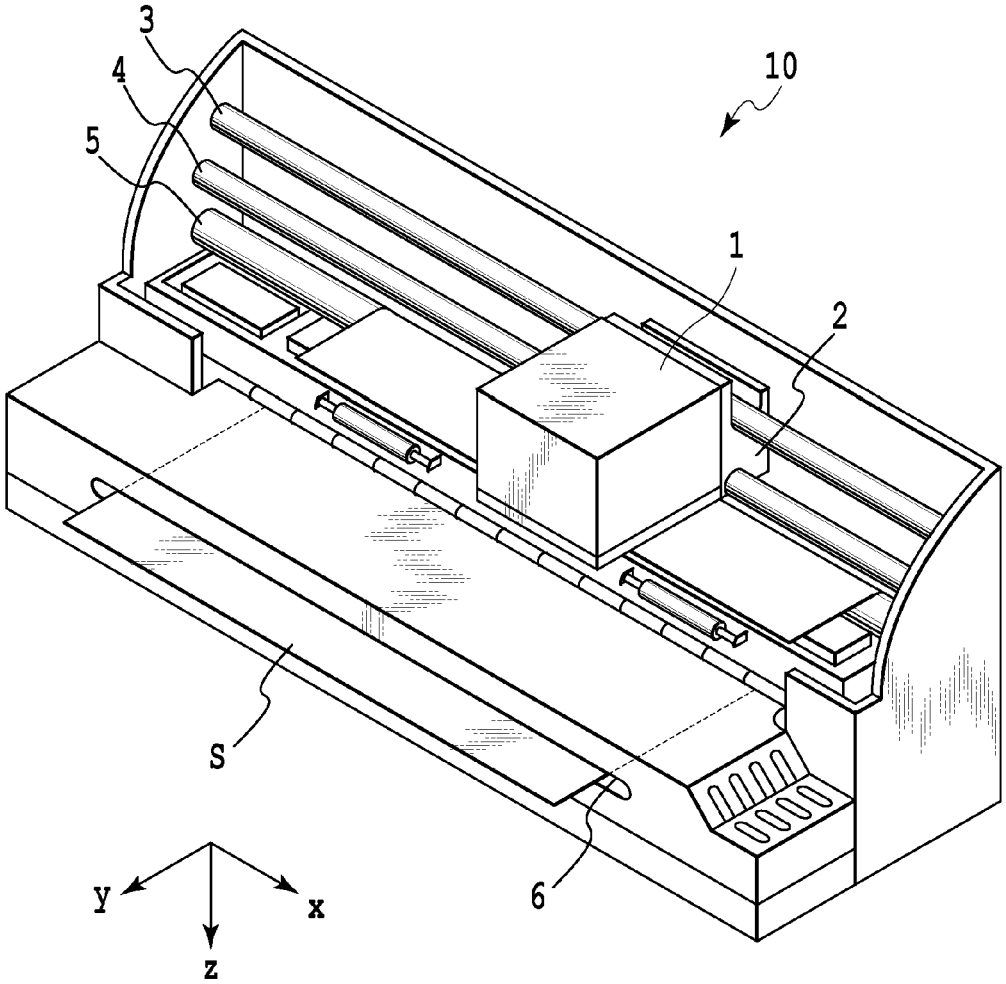
FIG. 1 is a schematic perspective view showing an internal configuration of a liquid ejecting apparatus using a liquid ejecting head.

FIG. 1 is a schematic perspective view showing an internal configuration of a liquid ejecting apparatus (hereinafter, referred to as a "print apparatus") 10 using a liquid ejecting head (hereinafter, referred to as a "print head") 1. The print apparatus 10 is an ink-jet print apparatus of a serial scan system. In the print head 1, an ejection port (not shown) is formed on a surface facing a sheet S. The liquid is given to the sheet S by ejecting a liquid from the ejection port downward in the z direction shown in the drawing. Note that, here, a case where ink is ejected from the ejection port will be explained. The print head 1 is mounted on a carriage 2. The carriage 2 is reciprocatingly guided in the x direction by using guide shafts 3 and 4 extending in the main scanning direction (the x direction shown in the drawing).

The sheet S inverts, after being inserted into the print apparatus 10 from an insertion port 6 provided in the print apparatus 10, the traveling direction thereof, and then, is conveyed in a sub-scanning direction (the y direction shown in the drawing) by a roller 5. In the print apparatus 10, an image is printed on the sheet S by repeating a print operation of ejecting ink from the print head 1 along with the movement of the carriage 2, and a conveyance operation of the sheet S by the roller 5.

Here, the print head 1 is assumed to utilize, as energy for ejecting ink, heat energy that is generated from an electrothermal converter (heater) being a print element. In this case, the ink is caused to generate film boiling by heat generation of the heater, and the ink is ejected from the ejection port by a foaming energy at that time. Note that a piezoelectric element or the like may be used as the print element.

Figure 2:
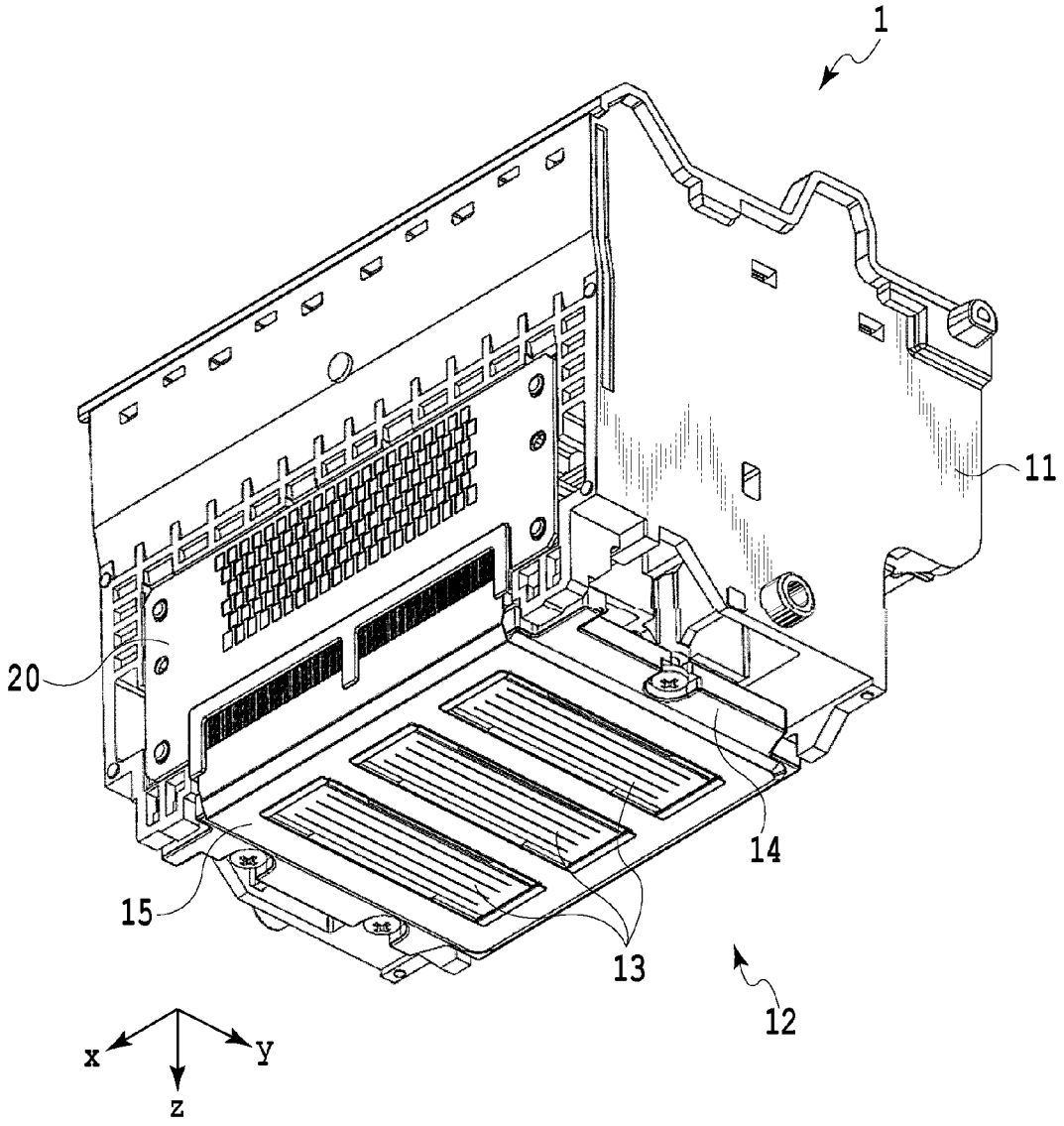
FIG. 2 is a perspective view showing the liquid ejecting head.

FIG. 2 is a perspective view showing the print head 1. As shown in the drawing, the print head 1 includes a housing 11, a contact substrate 20, a wiring member 15, and a print element substrate unit 12. The contact substrate 20, the wiring member 15, and the print element substrate unit 12 are fixed to the housing 11. An ink tank (not shown) storing ink is mounted on the housing 11, and a flow path for supplying ink to the print element substrate unit 12 from the ink tank is provided inside the housing 11.

The print element substrate unit 12 includes a print element substrate (liquid ejecting element substrate) 13. The print element substrate 13 is an Si substrate, and an opening serving as an ink flow path is formed on the print element substrate 13, by anisotropic etching. Furthermore, the print element substrate 13 is provided with a plurality of heaters as a print element. The print element substrate 13 is provided with a plurality of ink flow paths and a plurality of ejection ports formed by photolithography using a resin material. The ink in the ink tank passes through the flow path and goes toward the ejection port, by communicating the flow path of the housing 11 and the flow path of the print element substrate 13. Note that four openings each serving as the ink flow path are formed on one print element substrate 13, and inks of different colors can be ejected from ejection port rows of four rows in one print element substrate 13.

The print element substrate unit 12 has a support member 14 made from an alumina material, and the print element substrate 13 is supported by the support member 14. Note that, in FIG. 2, there is shown the case where three print element substrates 13 are used, but the number of usable print element substrates is not limited to three. Furthermore, in FIG. 2, there is shown the case where ejection port rows of four rows are formed for one print element substrate 13, but the row number of ejection port rows is also not limited to four.

The wiring member 15 electrically connects an electrode portion of the print element substrate 13 with a terminal in the contact substrate 20. Signals from the print apparatus 10 are transmitted to the print element substrate 13 of the print element substrate unit 12 via the contact substrate 20 and the wiring member 15. The wiring member 15 is provided with an opening portion in a position that corresponds to the position where the print element substrate 13 is arranged, and the opening shape of the opening portion is a rectangle. An electrode portion to be electrically connected with the electrode portion of the print element substrate 13 is provided near the short side of the opening portion. Furthermore, the wiring member 15 is provided with a connection portion for connecting electrically with the connection portion of the contact substrate 20. Note that an electric wiring tape or the like can be used as the wiring member 15.

Although details will be described later with reference to FIG. 4 and the like, various types of terminals are provided on the contact substrate 20. In addition, although description will be made later with reference to FIGS. 7A and 7B, the carriage 2 is provided with an electric connection pin 30, in a position that makes contact with the terminal of the contact substrate 20 in the case where the print head 1 is mounted. The electric connection pin 30 is electrically connected to a control circuit on the print apparatus 10 side. In the case where the terminal of the contact substrate 20 and the electric connection pin 30 are contact-connected to each other, the contact substrate 20 and a control circuit (not shown) on the print apparatus 10 side are electrically connected to each other, and electric power is supplied to the print element substrate 13 from the print apparatus 10 side via the contact substrate and signals are transmitted. Here, a low voltage differential signal transmission system (LVDS) is used as a transmission system of signals, but another transmission system may be used. Ejection of ink is controlled on the basis of the signal transmitted from the control circuit of the print apparatus 10, and an image is printed on the sheet S.

Figure 3:
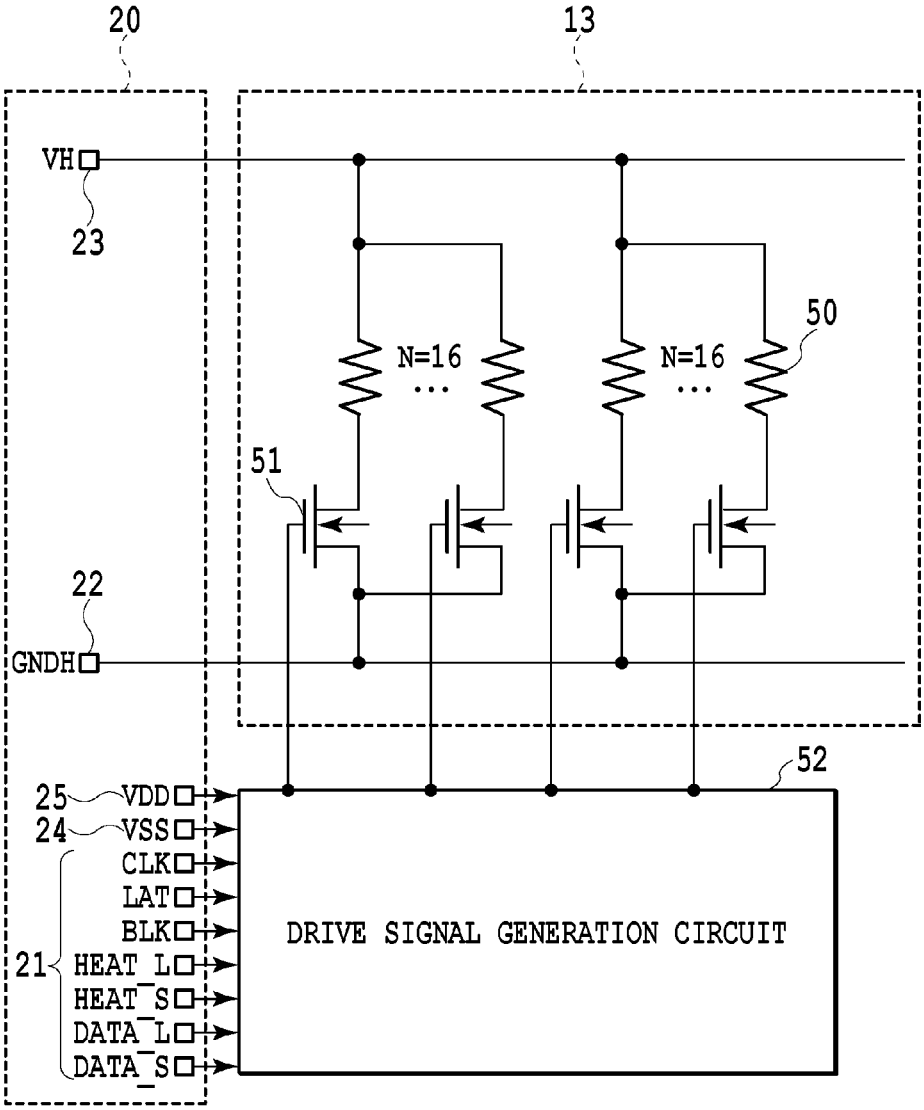
FIG. 3 is a circuit diagram showing a drive circuit of the liquid ejecting head.

FIG. 3 is a circuit diagram showing a drive circuit of the print head 1. The print element substrate 13 is provided with a heater 50, a drive element 51 and a drive signal generation circuit 52. The drive signal generation circuit 52 has a shift register circuit (not shown), a latch circuit (not shown), a decode circuit (not shown) and the like, and generates drive signals for the drive element on the basis of the signal from a control circuit of the print apparatus 10. In a case where the drive element 51 is turned ON according to the generated drive signal, a voltage is applied to the heater 50.

As shown in FIG. 3, a VH wiring and a GNDH wiring are separately wired for every block in the print element substrate 13, but each thereof is formed into one wiring in the contact substrate 20. According to this wiring, an electric current flowing through the VH wiring and the GNDH wiring in the contact substrate 20 increases along with the increase in number of print elements. In this case, noise enters control signals (data signals) transmitted by the DATA wiring, and an intended print operation may not be executed. Accordingly, here, terminals are arranged so as to suppress the influence of noise on data signals. Details will be described later with reference to FIGS. 5 and 6.

Figure 4A:
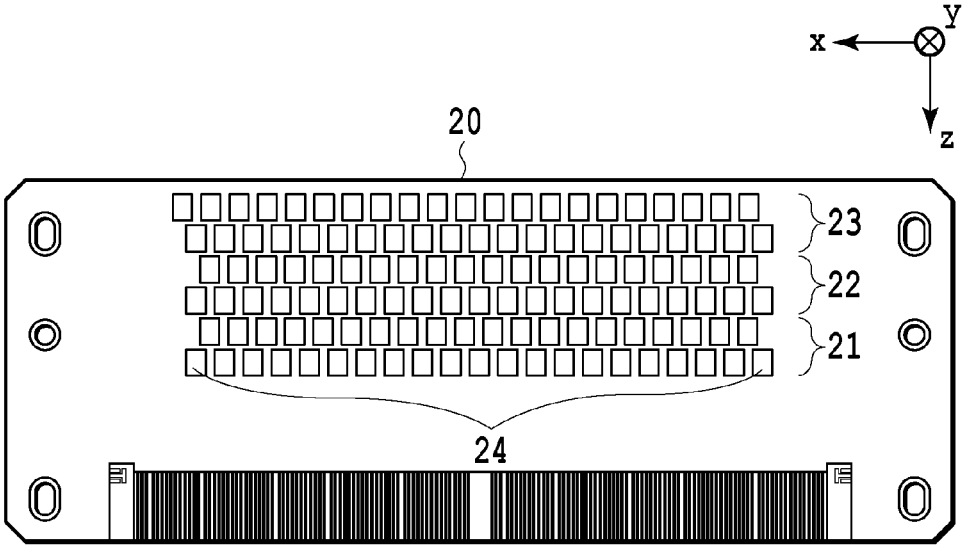
FIGS. 4A and 4B are schematic views each showing a contact substrate.
Figure 4B:
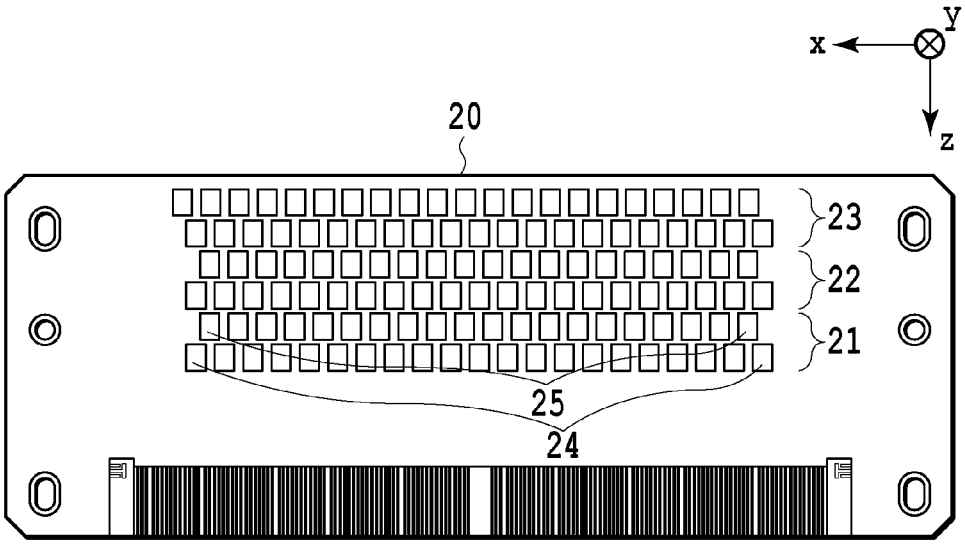

FIGS. 4A and 4B are schematic views showing a surface on which terminals of the contact substrate 20 are provided. As shown in FIGS. 4A and 4B, the contact substrate 20 is provided with a plurality of terminals 21 to 23, and has six rows of terminals that are constituted of a plurality of the terminals arranged along the x direction. The contact substrate 20 shown in FIGS. 4A and 4B is provided with one hundred and twenty-four terminals. The terminals include a print element (heater) power source terminal (VH) 23, a heater ground terminal (GNDH) 22, a data signal terminal (DATA) 21, a logic power source terminal (VDD) 25, and a ground terminal (VSS) 24. The VH (power source terminal for drive) 23 is a drive power source of the heater. The GNDH (ground terminal for drive) 22 is a ground of the heater. The DATA (signal terminal) 21 is a terminal that transfers serial data for independently turning ON/OFF respective heaters. The VDD (power source terminal for control) 25 is a power source for a logic signal, and the VSS (ground terminal for control) 24 is a ground for a logic signal. Namely, the VH 23 and the GNDH 22 are terminals for driving elements to drive the heater, and the DATA 21, the VDD 25 and the VSS 24 are terminals for controlling elements to control the heater. Here, a voltage of 32 V is assumed to be applied to the VH 23 and the GNDH 22, and a voltage of 3.3 V is assumed to be applied to the VDD 25 and the VSS 24.

As shown in FIGS. 4A and 4B, terminal rows of two rows including a plurality of DATAs 21, terminal rows of two rows including a plurality of GNDHs 22, and terminal rows of two rows including a plurality of VHs 23 are arranged in this order of positions closer to the wiring member 15 (the print element substrate 13). Furthermore, as shown in FIGS. 4A and 4B, in the terminal row at the lowermost part in the z direction among the terminal rows of the DATA 21, the VSS 24 is arranged on both sides in the arrangement direction of the terminals (x direction). Moreover, in FIG. 4B, the VDD 25 is arranged on both sides in the x direction of the terminal row of the second terminal row from the bottom in the z direction among the terminal rows of the DATA 21.

Here, with reference to FIG. 3 again, a flow of drive of the print element by signals that are input from a terminal will be explained. In the configuration shown in FIG. 3, there is used a time division drive system in which print elements are sequentially driven for each block while setting sixteen print elements as one block. CLK shown in FIG. 3 is a terminal that transfers clock signals for synchronizing the transfer of serial data that is input to the DATA 21. LAT is a terminal that transfers a latch signal serving as a trigger for shifting the serial data to a holding circuit in a print element substrate. BLK is a terminal that transfers a block selection signal for selecting a block to be driven. HEAT is a terminal that transfers a pulse signal for controlling VH application time with respect to a print element by pulse length.

The serial data that has been input via the DATA 21 are transferred to a shift register circuit (not shown) in the print element substrate 13 in synchronization with the clock signal. A data group input to the shift register circuit is held in a latch circuit (not shown) by the input of the latch signal, and a pulse-shaped drive signal is generated by subjecting the held data, the pulse signal and the block selection signal to AND processing. The drive element 51 is turned ON/OFF by the drive signal, and thus the drive of the heater 50 (print element) is turned ON/OFF.

Figure 5:
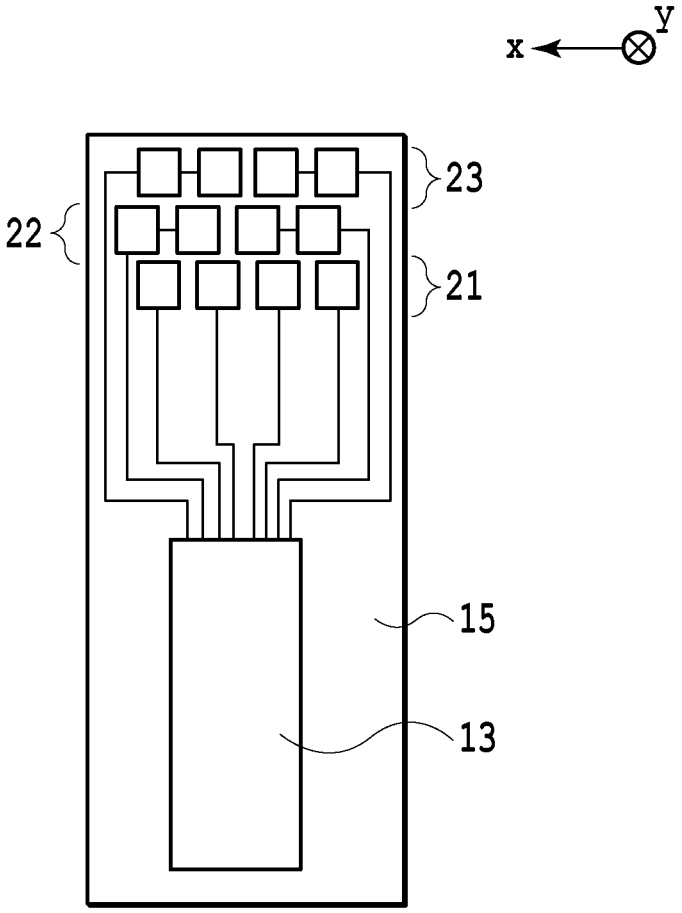
FIG. 5 is a schematic view showing a layout of terminals and wirings.

FIG. 5 is a schematic view showing a layout of terminals and wirings. Note that it is not indispensable to provide terminals on the contact substrate 20 as shown in FIGS. 2 and 4, but terminals may be patterned on the wiring member 15. In FIG. 5, the case where terminals and wirings are patterned on the wiring member 15 is shown. Also in FIG. 5, in the same way in FIGS. 4A and 4B, the terminal row of the DATA 21, the terminal row of the GNDH 22 and the terminal row of the VH 23 are arranged in order of positions closer to the print element substrate 13. In this case, when a simple wiring configuration is to be adopted, the configuration shown in FIG. 5 is given. Since the DATA 21 is arranged in a position closest to the print element substrate 13, the length of the DATA wiring gives the shortest distance among possible configurations that may be considered, as shown in FIG. 5.

Figure 6:
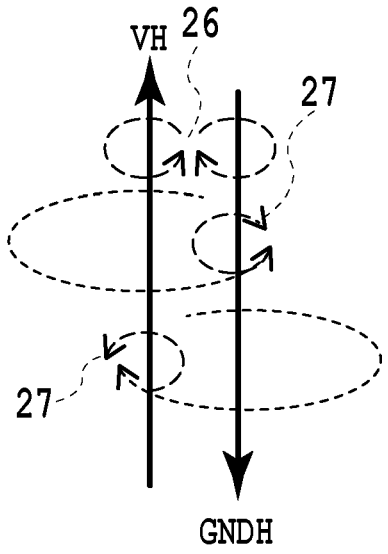
FIG. 6 is a schematic view for explaining the influence of noise.

FIG. 6 is a schematic view for explaining the influence of noise. As shown in FIG. 6, in the VH wiring (power source wiring) and the GNDH wiring (ground wiring), flows of the signal are opposite to each other. Intensity of a magnetic field is proportional to the magnitude of an electric current and inversely proportional to distance. As shown in FIG. 6, when the VH wiring and the GNDH wiring are made to run in parallel to each other, magnetic fields generated from both are intensified in a region 26 being a region between the VH wiring and the GNDH wiring, and are weakened in a region 27 being a region not between the VH wiring and the GNDH wiring. Accordingly, in the case where a DATA wiring (signal wiring) is arranged between the VH wiring and the GNDH wiring, the influence of noise on data signals becomes large. In contrast, here, as shown in FIG. 5, the DATA 21 is arranged in a position that is closest to the print element substrate 13, and thus the VH wiring and the GNDH wiring are made to run in parallel without arranging a DATA wiring between the VH wiring and the GNDH wiring. Therefore, in the present embodiment, the influence of noise on data signals can be suppressed.

In this way, here, the DATA 21 is arranged in a position closer to the print element substrate 13 than other terminals, and thus the DATA wiring is comparatively shortened and the distance of running parallel to another wiring is shortened. In this case, it is possible to make the VH wiring and the GNDH wiring run parallel to each other and to arrange the DATA wiring outside the region between the VH wiring and the GNDH wiring. Accordingly, the influence of noise on data signals can be suppressed, and a transmission performance of data signals from the print apparatus 10 side to the print element substrate 13 can be ensured. Note that, as shown in FIG. 5, in the case where the GNDH 22 and the VH 23 are arranged adjacent to each other, the VH wiring and the GNDH wiring can be arranged in parallel without adopting a complicated configuration.

Figure 7A:
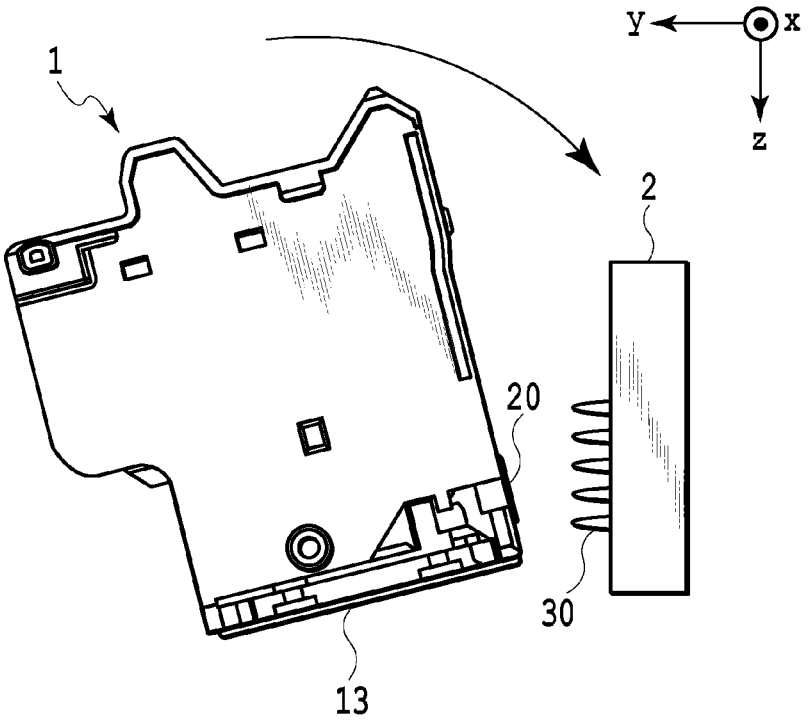
FIGS. 7A and 7B are drawings each showing a mounting method of the liquid ejecting head.
Figure 7B:
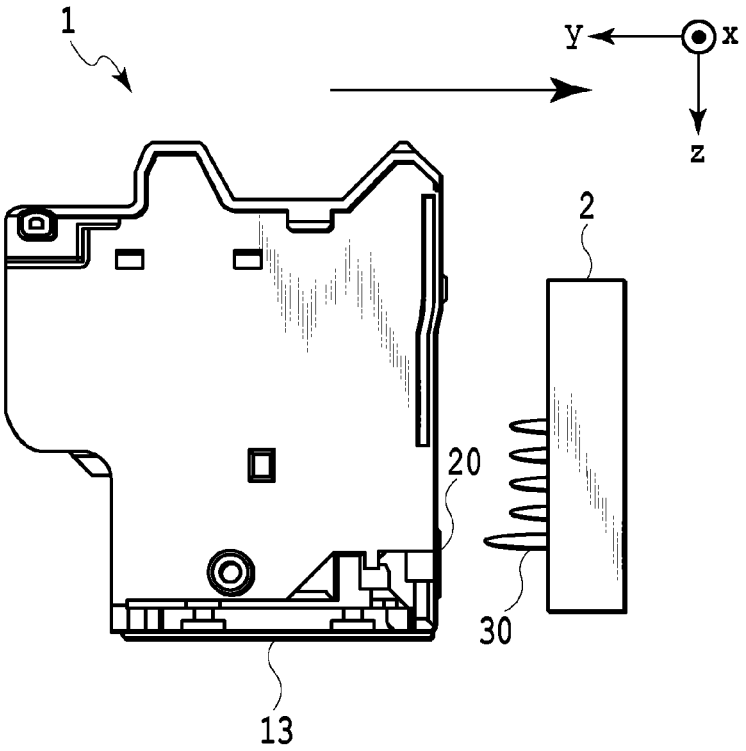

FIGS. 7A and 7B are drawings for explaining a mounting method of the print head 1 onto the carriage 2. FIG. 7A shows the case where a rotational mounting is performed, and FIG. 7B shows the case where a slide mounting is performed. As shown in FIGS. 7A and 7B, the electric connection pin 30 that is provided on the carriage 2 and the contact substrate 20 of the print head 1 face each other, and the print head 1 is mounted onto the carriage 2. Here, in any method, it is configured so that a terminal that is arranged at the lowest part in the z direction is first connected with the electric connection pin 30.

In the case where the rotational mounting shown in FIG. 7A is performed, the lower end portion in the z direction in the surface of the print head 1 facing the electric connection pin 30 is brought close to the electric connection pin 30, and the print head 1 is rotated in the clockwise direction when the drawing is viewed from the front while utilizing the end portion as a supporting point. Accordingly, the VSS 24 arranged at the lower part in the z direction is first connected to the electric connection pin 30, or the DATA 21 and the VSS 24 are simultaneously connected to the electric connection pin 30.

In the case where the slide mounting shown in FIG. 7B is performed, there is adopted a configuration of projecting an electric connection pin to be connected with the VSS 24 toward the y direction (toward the outside) more than other electric connection pins, and thus the VSS 24 is first connected to the electric connection pin, or the DATA 21 and the VSS 24 are simultaneously connected to the electric connection pin. In this case, the electric connection pin to be connected with the VSS 24 is set to have a length that is equal to or longer than the length of an electric connection pin to be connected with the DATA 21.

When the mounting method explained referring to FIGS. 7A and 7B is to be adopted in the arrangement of terminals explained referring to FIGS. 4A and 4B, the VSS 24 is first connected to the electric connection pin 30 and, at the same time or subsequently, the DATA 21 is connected to the electric connection pin 30. Accordingly, latch-up generated in the case or the like where the VSS 24 is connected after the DATA 21 is connected to the electric connection pin 30, can be prevented. In this way, here, latch-up can be prevented by adopting a mounting method in which the VSS 24 is first connected to the electric connection pin 30, or the DATA 21 and the VSS 24 are simultaneously connected to the electric connection pin 30.

Note that, in both configurations shown in FIGS. 4A and 4B, the VSS 24 is arranged at both ends of the terminal row at the lowermost part in the z direction. In the case where the print head 1 is mounted on the carriage 2 by arranging the VSS 24 in this way, even if the print head 1 makes partial contact with the carriage 2, the electric connection pin 30 can be first connected to either of the VSSs 24 at both ends, or can be simultaneously connected to the DATA 21 and the VSS 24.

FIG. 4B shows a configuration in which the VDD 25 is arranged at both ends in the x direction of a terminal row in a position close to the print element substrate 13 next to the terminal row at the lowermost part in the z direction. In the case of the configuration, when performing rotational mounting as shown in FIG. 7A, the VSS 24 is first connected to the electric connection pin 30, subsequently, the VDD 25 is connected to the electric connection pin 30, and the GNDH 22 and the VH 23 are connected after being brought into a state where a logic voltage is applied to the DATA 21. As described above, here, the VSS 24 and the VDD 25 can be connected to the electric connection pin 30 prior to the VH 23 and the GNDH 22. Note that the arrangement of the VDD 25 is not limited to the position shown in FIG. 4B, but the VDD 25 may be arranged in any position, only if it is a position that is connected to the electric connection pin 30 after the VSS 24.

As described above, here, there can be prevented the generation of latch-up caused by the connection or the like of a contact point of a signal system to an electric connection pin before the connection of a contact point of a ground system to the electric connection pin.

Figure 8A:
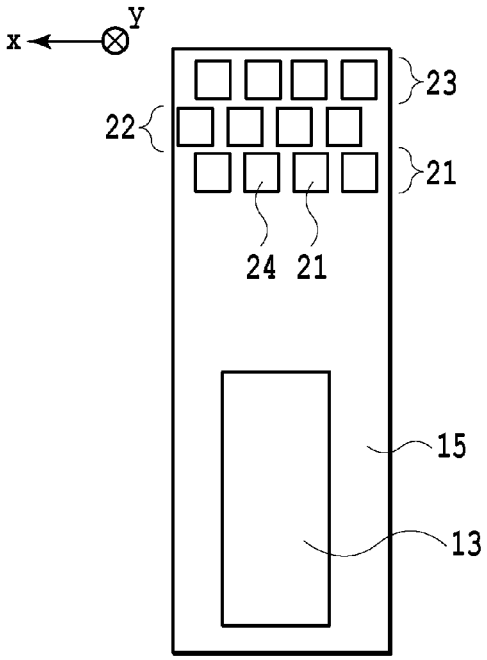
FIGS. 8A to 8C are schematic views each showing other examples of a layout of terminals.
Figure 8B:
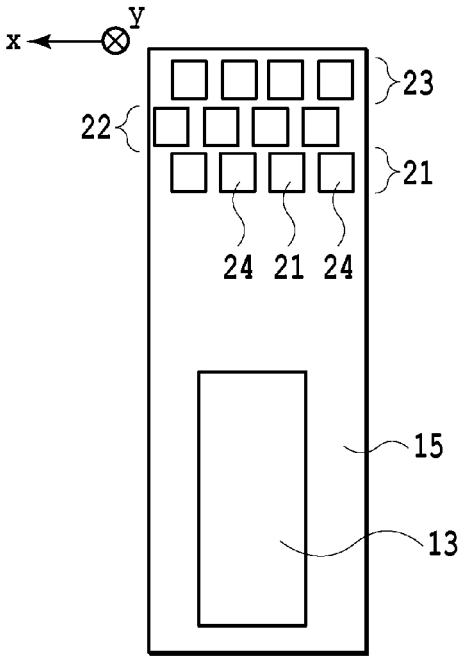
Figure 8C:
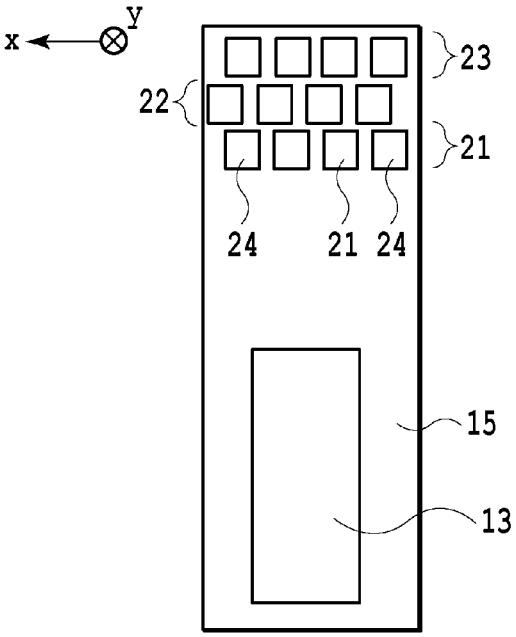

FIGS. 8A to 8C are schematic views showing other examples of a layout of terminals. Specifically, FIGS. 8A to 8C are schematic views showing examples of the positional relationship between the DATA 21 and the VSS 24 in a configuration similar to the configuration shown in FIG. 5. In FIGS. 8A to 8C, terminal rows of three rows that are constituted, respectively, of four terminals. Note that, in FIGS. 8A to 8C, illustration of wirings is omitted. Furthermore, also in the cases shown in FIGS. 8A to 8C, the print head 1 is assumed to be mounted onto the carriage 2 by the mounting method described in FIG. 7A or 7B.

FIG. 8A shows an example in which one VSS 24 is arranged next to the DATA 21 in the central portion of the terminal row in the x direction. Even in the arrangement, the VSS 24 can be connected to the electric connection pin 30 at the same time as the DATA 21 or prior to the DATA 21. FIG. 8B shows an example in which the VSS 24 is arranged on both adjacent sides of the DATA 21. Furthermore, FIG. 8C shows an example in which the VSS 24 is arranged at both ends in the x direction. In consideration of partial contact or the like in mounting the print head 1 onto the carriage 2, two or more VSSs 24 are more preferably arranged so as to sandwich the DATA 21, as in FIGS. 8B and 8C.

The above-described print head can also be used for: apparatuses such as a copier, a facsimile machine having a communication system and a word processor having a print unit; industrial print apparatuses combined compositely with various types of processing apparatuses; and the like.

In the above-described embodiments, the print head to be used in print apparatuses has been explained as a liquid ejecting head, but the present invention can also be applied to various types of liquid ejecting heads other than the print head. Furthermore, in the embodiments, the case where ink is used as a liquid to be ejected from the liquid ejecting head has been explained, but a liquid such as various processing liquid other than ink may be used as the liquid.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-104492, filed May 22, 2015, which is hereby incorporated by reference herein in its entirety.

What is claimed is:

1. A liquid ejecting head comprising:

a plurality of terminals for being electrically connected with a contact point provided in a liquid ejecting apparatus; and a liquid ejecting element substrate having a liquid ejecting element formed for ejecting a liquid in response to a control signal transmitted from the liquid ejecting apparatus, wherein the plurality of terminals includes signal terminals and ground terminals for control, for controlling the liquid ejecting element, the plurality of terminals are arranged such that a plurality of terminal rows, in which a plurality of terminals is arrayed in a first direction, is arranged in a second direction that is perpendicular to the first direction, and the ground terminals are arranged at both ends of one terminal row that is positioned closest to the liquid ejecting element substrate among the plurality of terminal rows in the second direction and the signal terminals are arranged between the ground terminals.

2. The liquid ejecting head according to claim 1, wherein the plurality of terminals includes an electric source terminal for drive and a ground terminal for drive, for driving the liquid ejecting element, and a signal wiring that connects the signal terminals with the liquid ejecting element substrate is arranged outside a region between an electric source wiring that connects the electric source terminal for drive with the liquid ejecting element substrate and a ground wiring that connects the ground terminal for drive with the liquid ejecting element substrate.

3. The liquid ejecting head according to claim 1, wherein the ground terminals for control are arranged so as to sandwich the signal terminals therebetween.

4. The liquid ejecting head according to claim 3, wherein all of the signal terminals are included in the one terminal row that is arranged at a position closer to the liquid ejecting element substrate than other terminal rows.

5. The liquid ejecting head according to claim 4, wherein all of the signal terminals are arranged in the one terminal row arranged in a position closest to the liquid ejecting element substrate and in another terminal row arranged in a position close to the liquid ejecting element substrate next to the one terminal row.

6. The liquid ejecting head according to claim 5, wherein an electric source terminal for control for controlling the liquid ejecting element is arranged at both ends of the other terminal row arranged in the position close to the liquid ejecting element substrate next to the one terminal row, in the second direction.

7. The liquid ejecting head according to claim 1, wherein a ground terminal for drive for driving the liquid ejecting element is arranged at a position farther from the liquid ejecting element substrate than a position of the signal terminals, and an electric source terminal for drive for driving the liquid ejecting element is arranged at a position farther than the farther position.

8. The liquid ejecting head according to claim 7, wherein the electric source terminal for drive and the ground terminal for drive are arranged adjacent to each other.

9. The liquid ejecting head according to claim 1, wherein the signal terminals and the ground terminals for control are arranged so as to be simultaneously connected to the contact point or the ground terminals for control are connected prior to the signal terminal.

10. The liquid ejecting head according to claim 1, wherein the liquid ejecting head is rotated with respect to the liquid ejecting apparatus to be mounted thereon.

11. A liquid ejecting apparatus capable of mounting a liquid ejecting head, wherein the liquid ejecting head has a plurality of terminals for being electrically connected with a contact point provided in a liquid ejecting apparatus; and a liquid ejecting element substrate having a liquid ejecting element formed for ejecting a liquid in response to a control signal transmitted from the liquid ejecting apparatus, the plurality of terminals includes signal terminals and ground terminals for control, for controlling the liquid ejecting element, the plurality of terminals is arranged such that a plurality of terminal rows, in which a plurality of terminals are arrayed in a first direction, is arranged in a second direction that is perpendicular to the first direction, and the ground terminals are arranged at both ends of one terminal row that is positioned closest to the liquid ejecting element substrate among the plurality of terminal rows in the second direction and the signal terminals are arranged between the ground terminals.

12. The liquid ejecting apparatus according to claim 11, wherein the liquid ejecting head is mounted so as to be electrically connected to the ground terminals for control prior to or at the same time as the signal terminals.

13. The liquid ejecting apparatus according to claim 12, wherein the contact point is an electric connection pin that projects toward an outside from a surface facing the terminals, and an electric connection pin to be electrically connected with the ground terminals for control projects more toward an outside than other electric connection pins.

* * * * *